US008449969B2

(12) United States Patent
Keller et al.

(10) Patent No.: US 8,449,969 B2
(45) Date of Patent: May 28, 2013

(54) SECURITY ELEMENT FOR SECURITY PAPERS AND VALUABLE DOCUMENTS

(75) Inventors: Mario Keller, Bad Endorf (DE); Theo Burchard, Gmund (DE)

(73) Assignee: Giesecke & Devrient GmbH, Munich (DE)

( * ) Notice: Subject to any disclaimer, the term of this patent is extended or adjusted under 35 U.S.C. 154(b) by 948 days.

(21) Appl. No.: 10/498,863

(22) PCT Filed: Dec. 17, 2002

(86) PCT No.: PCT/EP02/14415

§ 371 (c)(1),
(2), (4) Date: Jun. 16, 2004

(87) PCT Pub. No.: WO03/053713

PCT Pub. Date: Jul. 3, 2003

(65) Prior Publication Data

US 2005/0104364 A1 May 19, 2005

(30) Foreign Application Priority Data

Dec. 21, 2001 (DE) ..... 101 63 264

(51) Int. Cl.
*B41M 5/00* (2006.01)

(52) U.S. Cl.
USPC ..... 428/195.1; 263/110; 263/82; 263/72; 263/57

(58) Field of Classification Search
USPC ..... 428/195.1; 283/110, 82, 72, 57, 283/67
See application file for complete search history.

(56) References Cited

U.S. PATENT DOCUMENTS

| | | | | |
|---|---|---|---|---|
| 987,678 | A | 3/1911 | Howes et al. | |
| 1,903,711 | A | 5/1931 | Wendel | |
| 2,532,664 | A | 6/1946 | Freedman | |
| 3,770,943 | A | 11/1973 | Sill | |
| 3,881,987 | A | 5/1975 | Benz | |
| 4,856,857 | A | 8/1989 | Takeuchi et al. | |
| 4,943,093 | A | 7/1990 | Melling et al. | |
| 5,176,405 | A * | 1/1993 | Kaule et al. | 283/83 |
| 5,210,777 | A | 5/1993 | Narabu et al. | |
| 5,265,916 | A | 11/1993 | Coe | |
| 5,388,862 | A | 2/1995 | Edwards | |

(Continued)

FOREIGN PATENT DOCUMENTS

| | | | |
|---|---|---|---|
| CA | 2122528 | A1 | 11/1994 |
| CA | 2325316 | A1 | 3/2001 |

(Continued)

OTHER PUBLICATIONS van Renesse, "Optical Document Security", Artech House, Boston London, ISBN 0-89006-619-1, Seiten 156 bis 161, 1994, pp. 153-161.

(Continued)

*Primary Examiner* — D. Lawrence Tarazano
*Assistant Examiner* — Tamra L Dicus
(74) *Attorney, Agent, or Firm* — Rothwell, Figg, Ernst & Manbeck, P.C.

(57) ABSTRACT

The invention relates to a security element for security papers, documents of value, ID cards or the like that is of self-supporting design and has two different security features. The security features are disposed on opposite sides of the security element, at least one the security features being optically variable.

30 Claims, 6 Drawing Sheets

U.S. PATENT DOCUMENTS

| | | | | |
|---|---|---|---|---|
| 5,405,500 | A | 4/1995 | Knight | |
| 5,424,119 | A * | 6/1995 | Phillips et al. | 428/328 |
| 5,465,301 | A | 11/1995 | Jotcham et al. | |
| 5,492,370 | A * | 2/1996 | Chatwin et al. | 283/110 |
| 5,783,275 | A | 7/1998 | Muck et al. | |
| 5,820,971 | A * | 10/1998 | Kaule et al. | 428/209 |
| 5,876,068 | A * | 3/1999 | Schneider et al. | 283/86 |
| 5,944,927 | A * | 8/1999 | Seifert | 156/153 |
| 5,949,927 | A | 9/1999 | Tang | |
| 6,210,777 | B1 * | 4/2001 | Vermeulen et al. | 428/195.1 |
| 6,355,140 | B1 | 3/2002 | Murakami et al. | |
| 6,428,051 | B1 | 8/2002 | Herrmann et al. | |
| 6,471,248 | B2 * | 10/2002 | Hardwick et al. | 283/72 |
| 6,474,695 | B1 * | 11/2002 | Schneider et al. | 283/72 |
| 6,491,324 | B1 * | 12/2002 | Schmitz et al. | 283/82 |
| 6,508,489 | B2 * | 1/2003 | Herrmann et al. | 283/57 |
| 6,545,166 | B2 * | 4/2003 | Honma et al. | 549/335 |
| 6,616,803 | B1 | 9/2003 | Isherwood et al. | |
| 6,686,027 | B1 * | 2/2004 | Caporaletti et al. | 428/195.1 |
| 6,903,850 | B2 | 6/2005 | Kay et al. | |
| 6,954,293 | B2 * | 10/2005 | Heckenkamp et al. | 359/2 |
| 7,054,042 | B2 * | 5/2006 | Holmes et al. | 359/2 |
| 2002/0015426 | A1 | 2/2002 | Kim | |
| 2005/0211403 | A1 | 9/2005 | Hard | |

FOREIGN PATENT DOCUMENTS

| | | | |
|---|---|---|---|
| CN | 1071634 | | 9/2001 |
| EP | 0013557 | A2 | 7/1980 |
| EP | 0229645 | A1 | 7/1987 |
| EP | 0290875 | A2 | 11/1988 |
| EP | 0400902 | | 5/1990 |
| EP | 0648616 | | 4/1995 |
| EP | 0667248 | | 8/1995 |
| EP | 0756945 | A1 | 5/1997 |
| GB | 1604463 | | 12/1981 |
| GB | 2311303 | | 9/1997 |
| HU | 219 095 | B | 2/2001 |
| HU | 0104929 | | 4/2002 |
| JP | 8-300859 | A | 11/1996 |
| JP | 10237799 | | 9/1998 |
| JP | 2001172897 | | 6/2001 |
| JP | 2001213074 | | 8/2001 |
| JP | 2001-315472 | A | 11/2001 |
| KR | 199825249 | | 7/1998 |
| RU | 2135667 | C1 | 8/1999 |
| SU | 178675 | | 1/1966 |
| WO | 9106925 | A1 | 5/1991 |
| WO | 9509274 | A1 | 4/1995 |
| WO | WO 95/10420 | A1 | 4/1995 |
| WO | 9813211 | A1 | 4/1998 |
| WO | WO 98/13211 | A1 | 4/1998 |
| WO | 99/04983 | A1 | 2/1999 |
| WO | WO 99/04983 | * | 2/1999 |
| WO | 0031571 | A1 | 6/2000 |
| WO | 0054985 | A1 | 9/2000 |
| WO | 0103945 | A1 | 1/2001 |
| WO | WO 02/00446 | * | 1/2001 |
| WO | 0153113 | A1 | 7/2001 |
| WO | 02/00445 | A1 | 1/2002 |
| WO | 02/00446 | A1 | 1/2002 |
| WO | WO 02/00445 | * | 1/2002 |
| WO | 03053713 | A1 | 7/2003 |

OTHER PUBLICATIONS

De La Rue "Insight and Innovation", 5 pages.

* cited by examiner

SECURITY ELEMENT FOR SECURITY PAPERS AND VALUABLE DOCUMENTS

CROSS-REFERENCE TO RELATED APPLICATION

This application is a National Phase of International Application Serial No. PCT/EP02/14415, filed Dec. 17, 2002.

FIELD OF THE INVENTION

This invention relates to a security element for security papers, documents of value, ID cards or the like that is of self-supporting design and has two different optically variable security features. Further, the invention relates to a security paper and to a document of value having such a security element.

DESCRIPTION OF THE BACKGROUND ART

WO 95/10420 describes a document of value in which, after production thereof, a through opening is punched which is then sealed off on one side with a cover foil protruding beyond the opening on all sides. The cover foil is transparent at least in a partial area so that if there is an attempt to copy the document of value the background shows through and is rendered accordingly by the copier. In addition, the cover foil can have a security feature, for example a hologram.

SUMMARY OF THE INVENTION

The invention is based on the problem of proposing a security element as well as a security paper and a document of value having elevated forgery-proofness in comparison to the prior art.

The inventive security element has two different security features disposed on opposite sides of the security element, at least one of the security features being optically variable. Optically variable means that the security feature has a different, visually recognizable appearance, such as an interplay of colors and/or different information, from different viewing angles.

The optically variable security features can be for example diffraction structures observable in reflected light, coarse grid structures whose optically variable impression is based solely on their reflective properties, thin-film elements or optically variable prints, the printing ink used containing at least one optically variable pigment, such as liquid-crystal pigments or interference-layer pigments. The security element can have any combinations of optically variable security features.

The other security features to be used according to the invention may be any printed images, semitransparent or screened metal layers or the like. The printed images can be done using any inks, which can also have machine-detectable properties such as luminescent, magnetic or electroconductive properties.

It is also within the scope of the invention to use different security features if they contain readable information and this information can be read true to side on both sides of the security element.

The inventive security element preferably has two different optically variable security features disposed on opposite sides of the security element so that only one of the optically variable security features is recognizable when the security element is viewed from one side.

It is especially advantageous to use the inventive security element in security papers or documents of value having a through opening. In a document of value according to the prior art described in WO 95/10420, which only has a security feature in the area of the opening, there is only one side on which the security feature can be viewed true to side and completely. Viewed from the back, the security feature can either not be recognized at all or only mirror-inverted. If the inventive security element is disposed in the area of the opening, however, a complete and true-to-side security feature can be recognized from both sides. This increases the protection from forgery since the opening, if produced by simple punching, can be produced just as simply by a forger. The double-sided security element, in contrast, cannot be readily copied. In particular if there is a textual relationship between the two security features or the security features show different views of the same motif.

For example, the first optically variable security feature can show the front view of a motif, such as an eagle or the face part of a portrait, while the second optically variable security feature shows the back of the eagle or the back of the head in the portrait. The two security features are moreover preferably disposed congruently so that a forger must overcome the additional problem of disposing them in register. The inventive security element moreover offers special advantages if the security features contain readable information that is preferably identical in both security features and can always be read true to side due to the two-layer structure of the security element.

A machine-testable layer can moreover be disposed between the security features. This can be at least one IR-absorbent, electrically conductive or magnetic layer. A plurality of such layers can also be disposed between the security features. Moreover, said intermediate layers do not need to be all-over but can be designed in the form of encodings or other information. It can also be expedient in certain cases to dispose an all-over color layer, preferably black color layer, between the security features so that only certain security features are visible from each side of the security element.

According to a preferred embodiment, the security element consists of a plastic foil provided with at least one opaque coating on each side. Each of said opaque coatings has interruptions, preferably in the form of characters, patterns, logos or the like. Said interruptions are disposed offset from each other. That is, in the area where one opaque coating has interruptions, the opposite opaque coating is executed all over. This guarantees that the security element only has information recognizable true to side on each side. The opaque coatings are preferably metal layers, but other coatings such as color layers can also be used. Combinations are also possible by which the first security feature consists of a metal layer of any color and the second of an opaque color layer or an optically variable printed layer or a thin-film coating. Layers or printing inks showing different colors upon lookdown and lookthrough can also be used.

The metals used can additionally have different colors and/or be designed to be translucent. If at least one of the layers is translucent the interruptions in the opposite layer can also be recognized in transmitted light. The translucency can be produced via the layer thickness or by using screens. These possible embodiments of the metal layer can also be used in all other examples described hereinafter in which metal layers are mentioned. The metals used are for example aluminum, iron, copper, gold, nickel. The term "metal" also refers within the scope of the invention to any alloys.

The interruptions can be produced by any methods, for example removal by laser radiation, etching methods or washing methods.

Providing such interruptions and their arrangement can of course also be transferred to all other security features having a metal layer or other vapor-deposited layers, such as diffraction structures or thin-film elements. If printing inks are used for producing the security features, such gaps can also be produced by negative printing.

According to a further preferred embodiment, the security element can also have a coating with the above-described gaps only on one side, while a semitransparent metal layer is disposed on the other side.

According to a further preferred embodiment, the security element has two plastic layers in which diffraction structures are embossed. At least one of said plastic layers is provided with a metal layer so that the diffraction structures are observable in reflected light. The second plastic layer can likewise be provided with a metal layer or a dielectric layer with a high refractive index. If the second plastic layer is also provided with a metal layer, the latter can have a different inherent color from that of the first metal layer.

The inventive security element need of course not necessarily be disposed in the area of an opening, but can be used expediently wherever it can be tested from both sides without impairment. The place may be for example a completely transparent area in a document of value, such as a plastic bank note or the like.

It is likewise possible to use the inventive security element as a security thread, which is incorporated e.g. in so-called "pendulum" window security papers. In such security papers the "window areas," where the security threads are directly accessible on the security paper surface and thus verifiable, are provided alternately on the front and back of the paper.

As is well-known, it cannot always be ensured in papermaking that the security threads are embedded in the paper true to side. For a security thread that is twisted and thus incorporated in laterally reversed fashion to be nevertheless readable, characters, texts, etc., are therefore normally provided alternately true to side and laterally reversed. Thus, one part is always readable regardless of the position of the security thread.

To eliminate this problem the inventive security element can of course also be used even if the security paper has window areas on one side.

The security element can further be used not only for protecting security papers or documents of value but also for protecting any goods from forgery. The same applies to the security paper and/or document of value provided with an inventive security element.

The security element can have any contours, being for example round, oval, rectangular, trapezoidal, star-shaped or strip-shaped.

If a strip-shaped security element is disposed in a document of value or security paper in the area of an opening, one of the security features is to be recognized over the total length of the strip, while the second is visible only in the area of the opening.

Production of the security feature is effected for example on a self-supporting carrier element, such as a transparent plastic foil which is then used as label material. Particularly when using diffraction structures as security features; however, it is alternatively expedient to produce a hot stamping foil whereby the complete layer structure of the security element is prepared on a carrier material and then transferred to the document of value or security paper at least in certain areas under the action of pressure and heat. The carrier material is then preferably removed.

The individual security features can also be prepared on separate carriers which are then laminated or interconnected via an adhesive layer.

BRIEF DESCRIPTION OF THE DRAWINGS

Individual embodiments of the invention will be explained in more detail hereinafter with reference to the figures, in which.

DETAILED DESCRIPTION OF THE INVENTION

Figure 1:
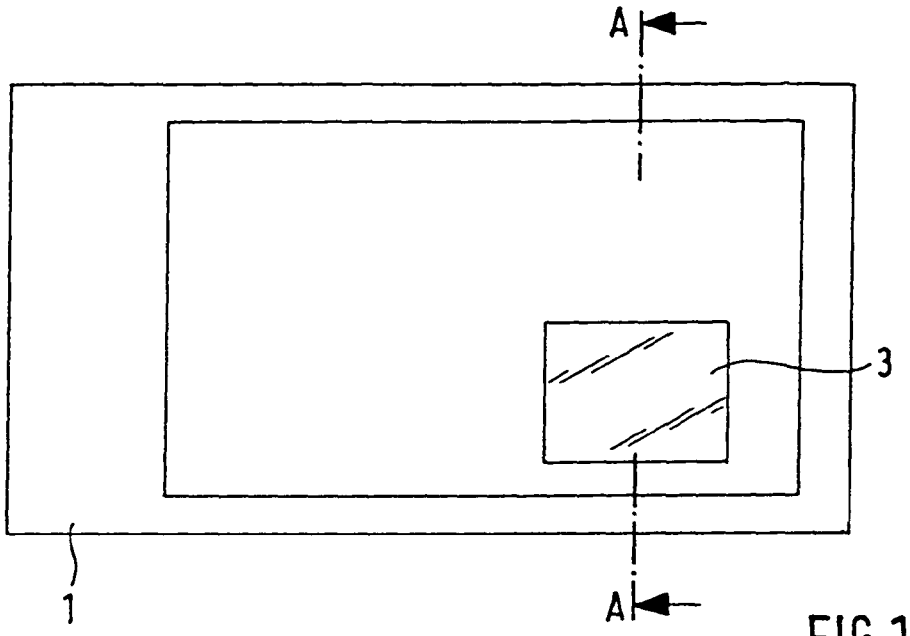
FIG. 1 shows an inventive document of value.

FIG. 1 shows a front view of an inventive document of value. The shown example involves bank note 1. Bank note 1 has through opening 2, but it is covered by security element 3.

Figure 2:
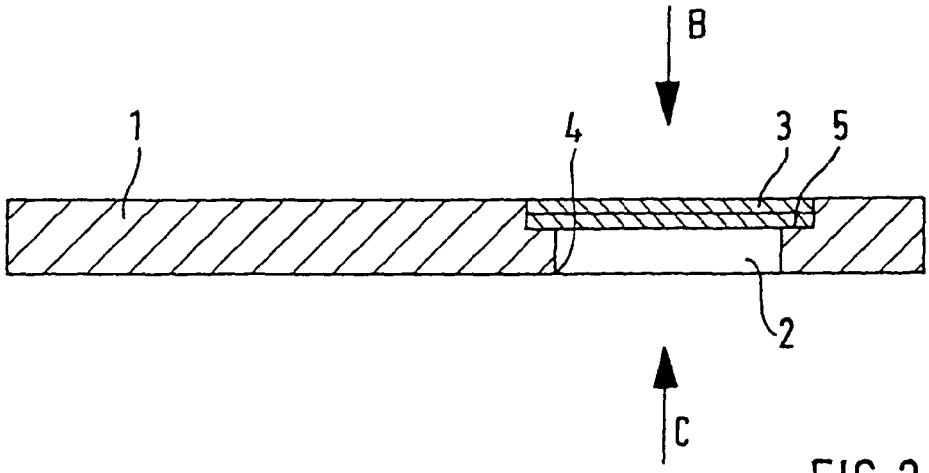
FIG. 2 shows a section through the document of value along line A-A.

FIG. 2 shows bank note 1 in cross section along line A-A. Opening 2 can be clearly recognized here. In the shown example, edges 4 of opening 2 are shown smooth, in the way they arise upon punching or cutting of bank note 1. If opening 2 is produced during production of the paper web used for bank note 1, however, edges 4 are irregular and fibrous. Fibrous edge 4 constitutes an additional authenticity feature since such an edge cannot be produced in the paper subsequently.

Opening 2 is closed on one side by inventive security element 3. In the shown example, security element 3 is disposed in bank note depression 5 surrounding opening 2. This gives bank note 1 a continuous stepless surface, which facilitates the handling, in particular stacking, of the bank notes.

According to the invention, security element 3 has a different appearance when viewed from direction B as when viewed from direction C. In the simplest case, security element 3 shows different picture motifs, texts, alphanumeric characters, patterns or combinations of said elements on each side.

To impede imitation of such security elements 3, however, the two appearances of security element 3 have a recognizable relationship to each other. For example, both sides can show the same true-to-side information, which is helpful in particular in the case of textual information since the text can be read true to side from both sides in this case. Thus a different appearance also exists if the same information is to be recognized on both sides, albeit true to side in each case.

Alternatively, security element 3 can also show different views of a motif. If the front view of an eagle is to be recognized from direction B, for example, the back of the eagle is to be recognized in direction C. The two representations are preferably disposed in register. Likewise, parts of total information that supplement each other can be disposed in register on both sides. Symmetrical information is preferably selected which is likewise perceived true to side from each side.

The different appearances of security element 3 arise through the combination of two different security features that are so disposed in security element 3 that only one of said features is visible to the viewer depending on the viewing direction.

Figure 3:
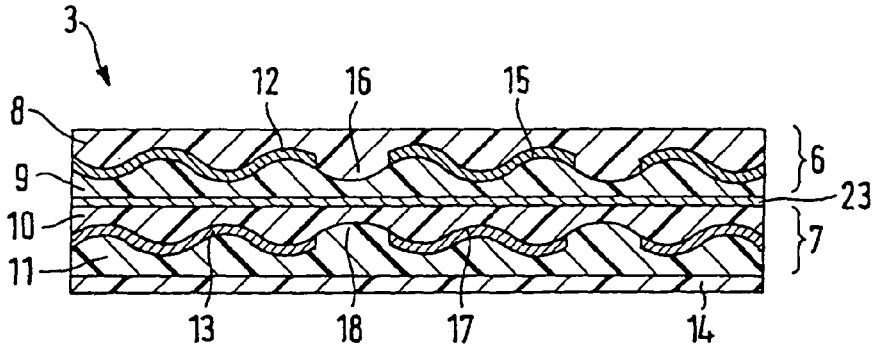
FIG. 3 shows one embodiment of the inventive security element.

FIG. 3 shows a first embodiment of inventive security element 3. It is composed of two different security features 6, 7, which each consist of a diffractive element in the present case. Security feature 6 has two plastic layers 8, 9 between which the diffraction structure is disposed in the form of relief structure 15. Between plastic layers 8, 9 there is additionally metal layer 12 to ensure that the information stored in the diffraction structures is recognizable in reflected light. Said metal layer can have interruptions 16 which can have the form of patterns, letters or other alphanumeric characters. Security feature 7 is constructed analogously and composed of two plastic layers 10, 11 between which diffraction structures 17 and metal layer 13 are disposed. Metal layer 13 can also have interruptions 18 in the form of any patterns and alphanumeric characters.

If interruptions 16, 18 are provided in metal layers 12, 13, middle layer 23 is preferably provided, it being designed opaque e.g. white or black, contrasting with the metal layer and preventing the mirror-inverted characters of the back from showing through. The interruptions can also be provided congruently, however.

The two security features 6, 7 can be either interconnected via an adhesive layer or laminated together without an adhesive layer. Security element 3 is finally connected with bank note 1 via adhesive layers 14.

Plastic layers 9, 11 serve primarily as protective layers and are optional. They are unnecessary in particular when the total layer structure is prepared on a carrier foil for a transfer material. In this case the carrier foil, which can optionally be pretreated with respect to its desired release properties, is coated with plastic layer 8. Diffraction structure 15 is embossed into plastic layer 8, and embossed relief structure 15 coated with metal layer 12 preferably by the vacuum deposition method. Plastic layer 10 is then applied to metal layer 12 and likewise embossed. Metal layer 13 is applied, preferably by vapor deposition, to plastic layer 10 provided with diffraction structures 17. The adhesive layer is applied to metal layer 13 for transfer to the end substrate. If metal layers 12, 13 have interruptions, additional steps are necessary which result from the particular method used, such as laser removal, etching or washing.

Relief structure 15 is designed for example such that when viewed from direction B the front of an eagle is visible, which changes color when bank note 1 is tilted. Diffraction structure 17, however, creates the visual impression of the back of an eagle, which likewise changes color when bank note 1 is tilted. Alternatively or additionally, the diffraction structure itself can also convey readable information, which is readable true to side on both sides.

Figure 4:
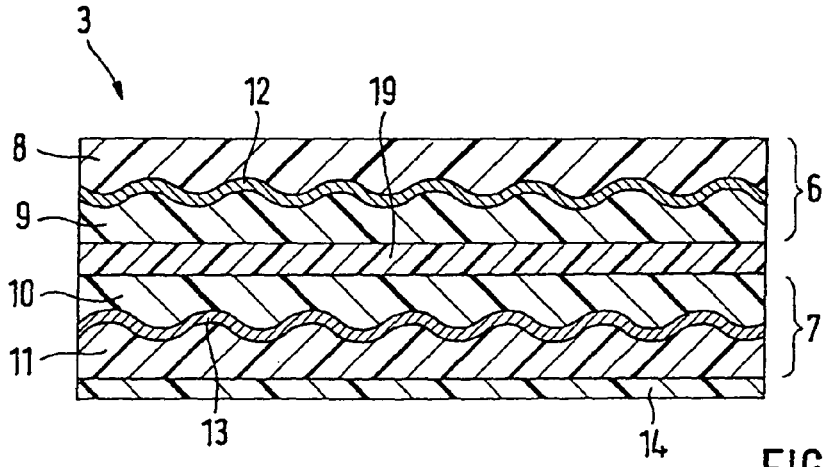
FIGS. 4-12 show further embodiments of the inventive security element.

FIG. 4 shows a variant of security element 3 shown in FIG. 3 wherein security features 6, 7 are interconnected via adhesive layer 19 and metal layers 12, 13 have no gaps 16, 18. Adhesive layer 19 can have machine-testable properties. It can for example be mixed with electrically conductive or magnetic pigments.

Figure 5:
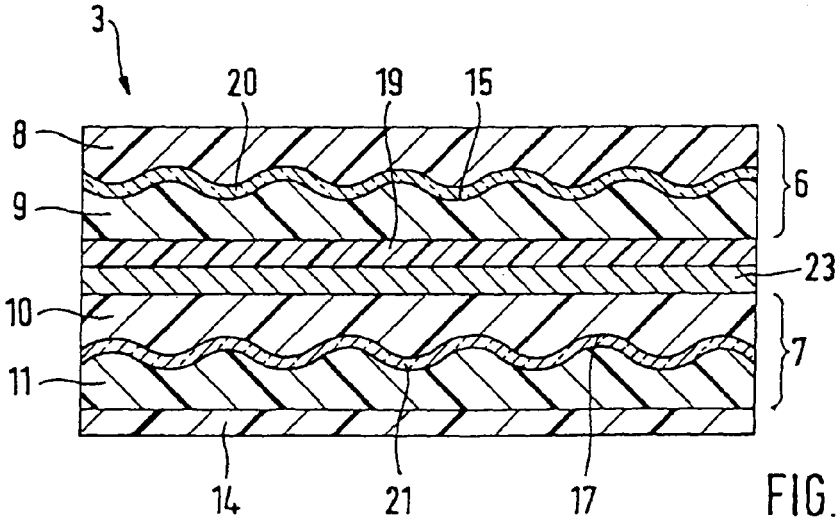

FIG. 5 shows a further embodiment of inventive security element 3. Here, too, security features 6, 7 each consist of two plastic layers 8, 9, 10, 11 between which there are diffraction structures 15, 17 in the form of a relief structure. In this case, however, diffraction structures 15, 17 are not combined with an opaque metal layer. Instead, plastic layers 8, 9; 10, 11 have therebetween dielectric layer 20; 21 having a refractive index different from plastic layers 8, 9, 10, 11 so that diffraction structures 15, 17 can likewise be viewed in reflected light. Since dielectric layers 20, 21 are transparent, an additional layer must be inserted between security features 6, 7 to ensure that only one of security features 6, 7 is visible in each case. In the shown example, this is black layer 23 which simultaneously increases the brilliance of the visual impression of diffraction structures 15, 17 since it absorbs the transmitted light. In the shown example, security element 3 additionally has adhesive layer 19 interconnecting the two security features 6, 7.

Depending on which adhesive properties or laminating behavior layer 23 has, adhesive layer 19 can also be omitted.

Instead of black color layer 23 a dark magnetic layer can also be used that produces the same optical effect and additionally ensures machine readability of security element 3. The magnetic layer can also be provided in addition to the color layer in order to prevent the magnetic layer from being spied out in transmitted light.

Figure 6:
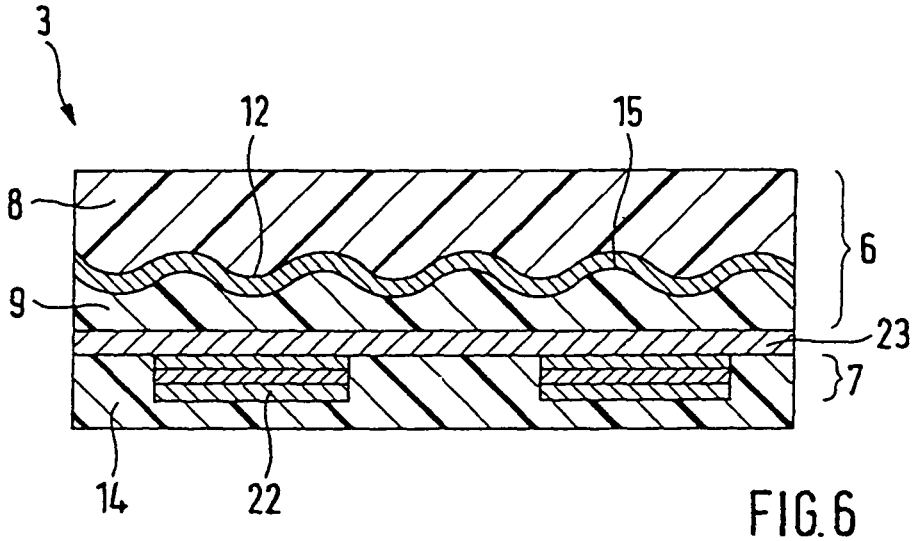

In the variant of security element 3 shown in FIG. 6, security features 6, 7 are designed differently. Security feature 6 still consists of a diffraction element as explained in the above-described figures. Security feature 7, however, consists in this case of thin-film structure 22 applied in certain areas and representing a certain motif, pattern or alphanumeric characters. To guarantee separate visual perceptibility of the two security features 6, 7 here, too, black layer 23 is disposed between security features 6, 7. Said layer additionally has the function of increasing the optical effect of thin-film structure 22 here, too.

The information represented by thin-film structure 22 can correspond to the information represented by diffraction structures 15, supplement it or, as mentioned above, show a different view of the same motif.

Instead of the thin-film structure, other effect layers or printing inks containing effect pigments can also be used. Said effect layers or effect pigments can be for example luminescent or absorbent, in particular IR-absorbent, substances, or liquid-crystal pigments, etc. A simple print is also possible.

Figure 7:
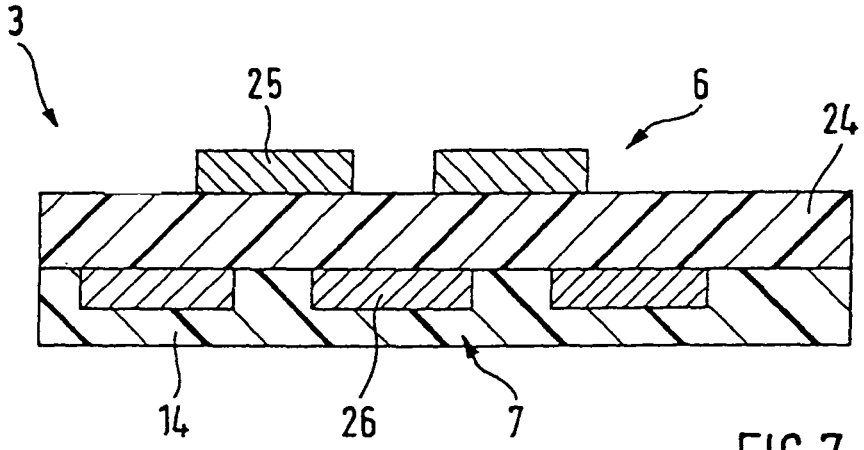

FIG. 7 finally shows an embodiment of inventive security element 3 wherein the two security features 6, 7 each consist of optically variable print 25, 26. A printing ink is used therefor that has at least one liquid-crystal or interference-layer pigment. Different optically variable pigments can be used for the two prints 25, 26.

If only one of prints 25, 26 is to be visible in each case, opaque carrier 24 is used. Carrier 24 is preferably a plastic foil which is preferably colored dark.

The shown examples each include adhesive layer 14 fastening security element 3 to bank note 1. However, adhesive layer 14 is optional. Instead, the adhesive layer can also be applied to the document itself or a different manner of fastening selected.

Figure 8:
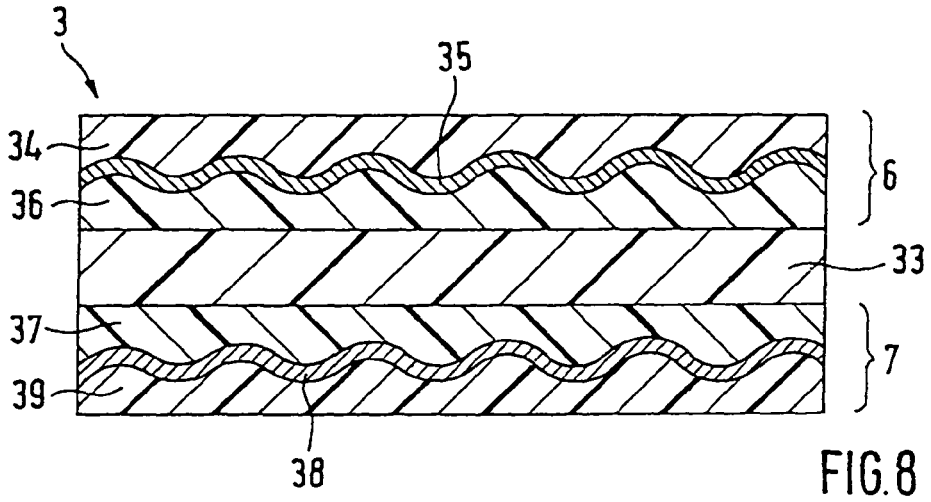

FIG. 8 shows an alternative embodiment of inventive security element 3. Here, carrier material 33, preferably a transparent plastic foil, is provided on one side with security feature 6 and on the other side with security feature 7. In the shown example, both security features 6, 7 consist of a diffraction structure observable in reflected light. Said diffraction structure is present in the form of a relief structure in plastic layer 36, 37 each provided with metal layer 35, 38. Metal layers 35, 38 are finally covered by protective layers 34, 39.

In the simplest case, plastic layers 36, 37 are provided with the same diffraction structure and security features 6, 7 differ only with respect to the color of metal layers 35, 38. The different color of metal layers 35, 38 can be produced by the use of special metals with different inherent colors. For example, metal layer 35 can consist of a silvery aluminum layer, and metal layer 38 of a copper layer. However, a different color effect of the metal layer can also be produced with the aid of protective layer 34, 39. In this case, the same materials are used for metal layers 35, 38, and protective layers 34, 39 are colored with corresponding translucent different colors. Alternatively or additionally, a different diffraction structure can also be selected for security features 6, 7.

Figure 9:
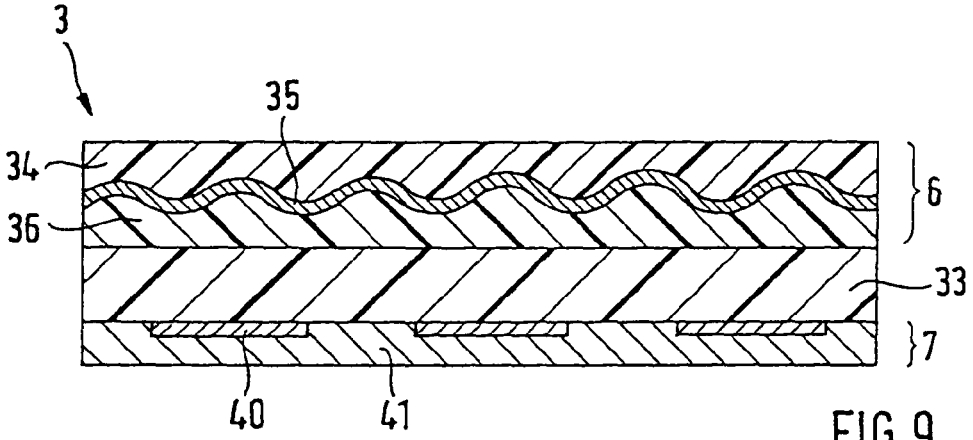

FIG. 9 shows a further embodiment of inventive security element 3 wherein different security features 6, 7 are used. Security feature 6 corresponds to the security feature with a reflective diffraction structure applied to carrier material 33 as explained above in FIG. 8. Security feature 7 disposed on the opposite side of carrier material 33 consists of printed image 40 covered by semitransparent layer 41. Semitransparent layer 41 can be a thin, translucent, all-over metal layer or a screened metal layer.

Figure 10:
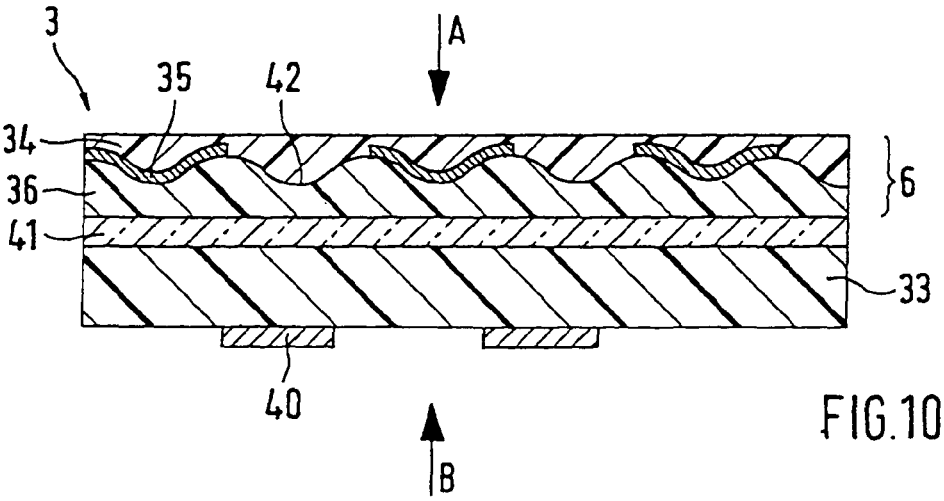

Alternatively, one can also use a multilayer structure having for example a diffraction structure analogous to security feature 6. However, in this case metal layer 35 must be replaced by a dielectric transparent layer revealing print 40, on the one hand, and making the diffraction structures visible in reflected light, on the other hand. In this example it can also be expedient to color carrier foil 33 to separate security features 6, 7 visually from each other. According to a further embodiment shown in FIG. 10, not all layers of a security feature need necessarily be disposed on the same side of carrier material 33. Thus, semitransparent layer 41 can also be disposed on the same side of carrier material 33 under security feature 6. In the example shown here, metal layer 35 moreover has interruptions of any form. The interruptions can also have the form of a relatively large area with any contour form, such as square, round, rectangular or the like. Said interruptions are to be recognized in reflected light when security element 3 is viewed from direction A. Semitransparent layer 41 disposed under security feature 6 ensures that print 40 is practically not to be recognized from this viewing direction. Only when viewed in transmitted light, print 40 shows through interruptions 42. When the security element is viewed from direction B, however, only print 40 can be readily recognized since semitransparent layer 41 disguises security feature 6 here, too.

Figure 11:
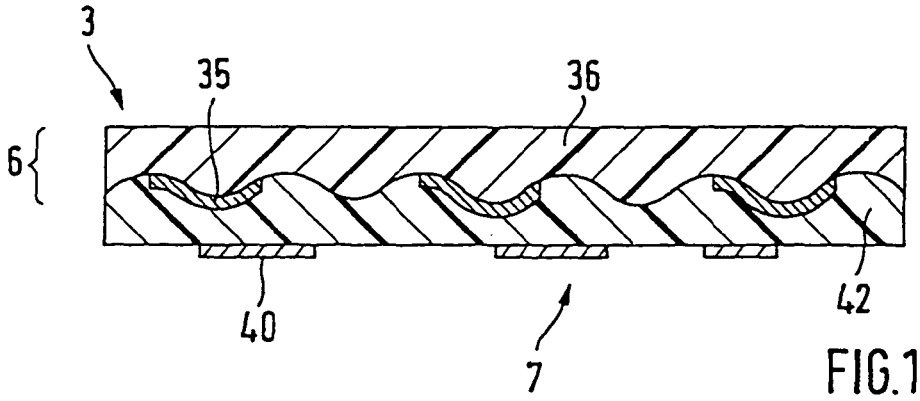

FIG. 11 shows a further embodiment of inventive security element 3. Security feature 6 consists in this case of a plastic layer in which diffraction structures are incorporated and which is then provided at least in certain areas with metal layer 35. Security feature 7 consists of print 40 separated visually from security feature 6 by opaque white printed layer 42.

Figure 12:
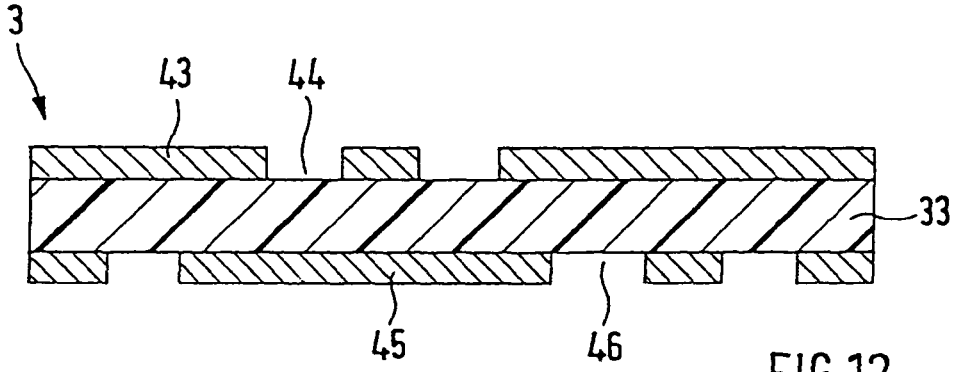

FIG. 12 finally shows an embodiment of the inventive security element wherein security feature 6 and security feature 7 each consist of an opaque coating having interruptions 44, 46 in certain areas. The essential point is that opaque coating 45 has no interruptions in the area of interruptions 44, i.e. that it is executed all over in this area. Conversely, opaque coating 43 is also executed all over in the area of interruptions 46. This ensures that the information represented by interruptions 44 is to be recognized only from one side of security element 3 in each case and, in the case of text, can always be read true to side. Opaque coating 43, 45 may involve any color layers and/or metal layers. Layers 43, 45 can be of different color, whereby, in the case of metal layers, the different color can also be produced by additionally printing on a translucent colored lacquer layer. Optically variable printing inks or metallic inks can also be used, which are applied to carrier material 33 as a negative print.

If metal layers are used for opaque coating 43, 45 they can of course be combined with diffraction structures, as explained above.

In all embodiments using diffraction structures as security features, said structures can also be executed as transparent diffraction elements by replacing the metal layer with a dielectric layer having a corresponding refractive index. Said dielectric layer might potentially also be a corresponding adhesive layer that serves as an element for connection to a further security feature or the end substrate.

If the security features have metal layers, the latter can also be executed to be semitransparent or in the form of a screened metal layer.

Figure 13:
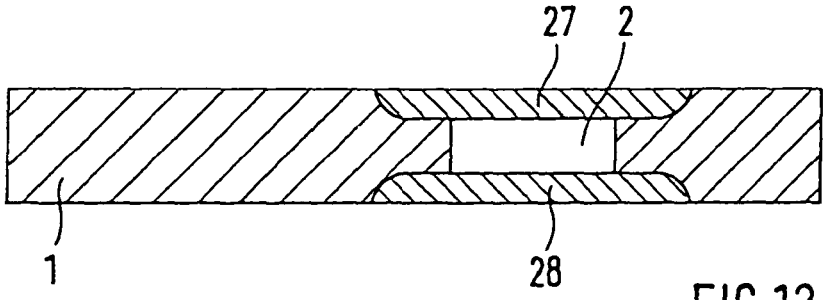
FIG. 13 shows a further embodiment of the inventive document of value.

FIG. 13 shows a further embodiment of the inventive document of value. In this case, opening 2 in bank note 1 is closed on each side by security feature 27, 28. That is, security element 3 is in this case not prepared as a uniform layer structure and then disposed in the area of the opening, but the individual parts of security element 3, that is, security features 27, 28, are each disposed separately on one side of the opening. Above-described security features 6, 7 can be used here analogously. They also show the same optical effects and also have an analogous relationship to each other with respect to the information represented.

Security element 3 shown in FIG. 1 can have any contour form. For example, it can be round, oval, rectangular, star-shaped, trapezoidal or the like. The contour can be adapted to the contour of opening 2 or match it.

Alternatively, security element 3 can also be executed in the form of a strip extending over the total width or length of the document of value. This embodiment is especially expedient if a security paper is used for producing the document of value and security element 3 is already to be applied to the security paper in continuous form.

Figure 14:
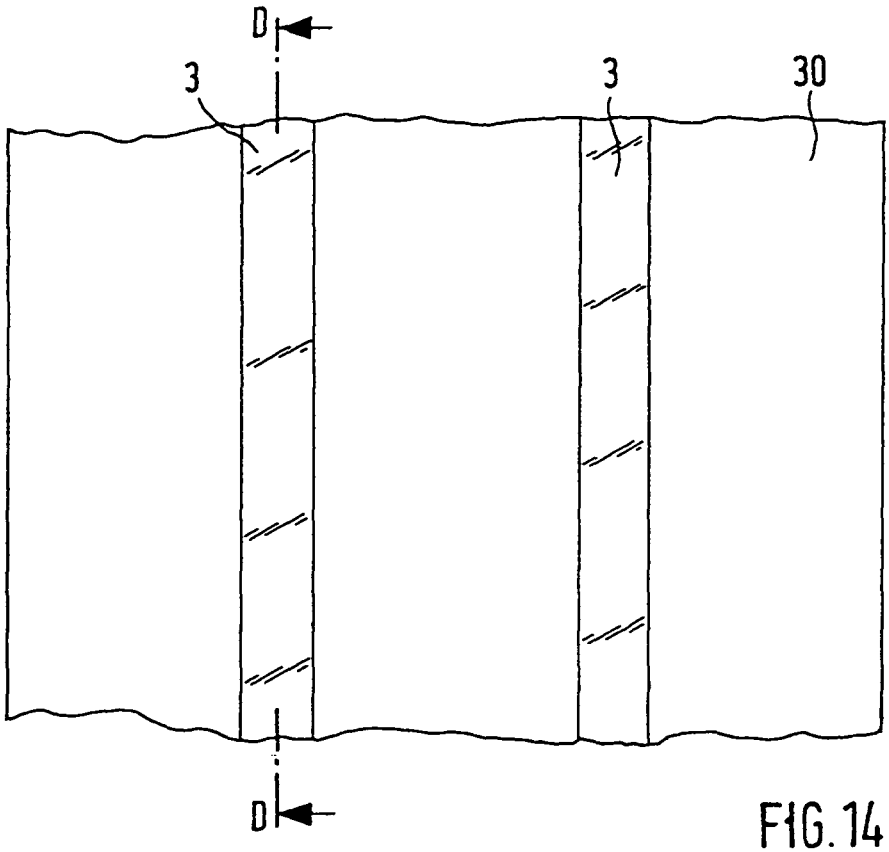
FIG. 14 shows an example of an inventive security paper.

FIG. 14 shows a detail of such a security paper 30 in a front view. Security elements 3 are applied to paper 30 at corresponding intervals in the form of strips by a continuous hot stamping method. In further processing steps, paper web 30 is then printed and cut into single documents.

Figure 15:
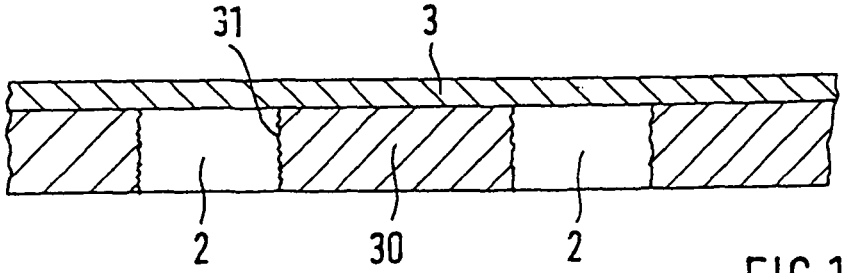
FIG. 15 shows a section through the security paper along line D-D.

FIG. 15 shows a cross section through paper web 30 along line D-D. One can see that paper web 30 has openings 2 at certain intervals under security element 3. Openings 2 are preferably spaced such that each later single document has opening 2. Openings 2 have been produced here during production of paper web 30, so that edges 31 of openings 2 are of irregular and fibrous form.

The security feature can also be executed as a security thread to be embedded in the security paper. In this case the security paper preferably has openings, so-called windows, on both sides.

The invention claimed is:

1. A security element for a security document, comprising at least two different security features disposed on opposite surfaces of the security element, the security features having a recognizable relationship to each other, wherein the at least two security features are optically variable diffraction structures in the form of relief structures having different appearances, observable in reflected light, whose optically variable impression for a viewer are based solely on their reflective properties.

2. A security element according to claim 1, characterized in that another security feature is a printed image or a semitransparent layer.

3. A security element according to claim 2, characterized in that the semitransparent layer is a thin metal layer or a screened metal layer.

4. A security element according to claim 2, characterized in that the printed image has IR-absorbent, luminescent, magnetic or electrically conductive properties.

5. A security element according to claim 2, characterized in that the printed image is a negative print.

6. A security element according to claim 1, characterized in that the security features are so disposed on the security element that only one of the security features is recognizable when the security element is viewed from one side.

7. A security element according to claim 1, characterized in that another optically variable security feature is an optically variable print made from a printing ink that contains at least one optically variable pigment, such as liquid-crystal pigments or interference-layer pigments.

8. A security element according to claim 1, characterized in that a machine testable and/or visually testable layer is disposed between the security features.

9. A security element according to claim 1, further comprising a visually testable layer that is a luminescent, IR-absorbent, electrically conductive or magnetic layer.

10. A security element according to claim 1, characterized in that a color layer, preferably black or white color layer, is disposed between the security features.

11. A security element according to claim 1, characterized in that at least one of the security features has a layer with interruptions in the form of characters, patterns, or logos.

12. A security element according to claim 1, characterized in that the security element consists of a multilayer foil structure, the different security features being two diffraction structures observable in reflected light that create a different optical impression.

13. A security element according to claim 12, characterized in that at least one of the diffraction structures observable in reflected light consists of a plastic layer and a metal layer provided at least in certain areas of the plastic layer, the plastic layer having the diffraction structures in the form of a relief structure.

14. A security element according to claim 13, characterized in that both security features have a plastic layer and a metal layer provided at least in certain areas of the plastic layer, the metal layers conveying a different color effect.

15. A security element according to claim 12, characterized in that the security element has two such security features between which a magnetic layer is disposed.

16. A security element according to claim 12, characterized in that at least one of the diffraction structures observable in reflected light consists of a plastic layer and a dielectric layer having a refractive index different from the plastic layer, so that the diffraction structures present in the plastic layer in the form of a relief structure are visible in reflected light.

17. A security element according to claim 16, characterized in that the security element has two such security features between which a black color layer is disposed.

18. A security element according to claim 1, characterized in that the security features show different views of the same motif.

19. A security element for a security document, comprising at least two different security features in form of optically variable diffraction structures in the form of relief structures having different appearances disposed on opposite surfaces of the security element, the security features each having an opaque coating with interruptions in the form of characters, patterns, or logos, such that the interruptions on the opposing surfaces of the security element do not overlap one another, characterized in that at least one of the opaque coatings is a metal layer.

20. A security element for a security document, comprising at least two different security features in form of optically variable diffraction structures in the form of relief structures having different appearances disposed on opposite surfaces of the security element, the security features each having an opaque coating with interruptions in the form of characters, patterns, or logos, such that the interruptions on the opposing surfaces of the security element do not overlap one another, characterized in that the opaque coatings have different colors.

21. A security paper for producing security documents, having at least one through opening in a paper layer, said through opening being closed on one side by a security element, the security element, having at least two different security features disposed on opposite surfaces of the security element, so that the different security features are recognizable in the area of the opening, wherein both security features are optically variable diffraction structures in the form of relief structures having different appearances, observable in reflected light, whose optically variable for a viewer are based solely on their reflective properties.

22. A document of value, having at least one through opening closed on one side by a security element, the security element having at least two different security features disposed on opposite surfaces of the security element, so that the different security features are recognizable in the area of the opening, wherein both security features are optically variable diffraction structures in the form of relief structures having different appearances, observable in reflected light, whose optically variable impressions for a viewer are based solely on their reflective properties.

23. A document of value, having a body with at least one through opening therein, said opening being closed on one side by a first optically variable security feature and on the opposite side by a second optically variable security feature, the security features being different and both optically variable security features are diffraction structures in the form of relief structures having different appearances, observable in reflected light, whose optically variable impressions are for a viewer based solely on their reflective properties.

24. A method for protecting goods from forgery comprising incorporating into said goods a security element according to claim 1.

25. A method for protecting goods from forgery comprising incorporating into said goods a security element according to claim 21.

26. A method for protecting of goods from forgery comprising incorporating into said goods a security element according to claim 22.

27. The security element of claim 19, wherein each of the at least one opaque coatings is a metal layer.

28. The security element of claim 27, wherein each of the metal layers is composed of a different material.

29. The security element of claim 20, wherein each of the at least one opaque coatings is a metal layer.

30. The security element of claim 29, wherein each of the metal layers is composed of the same material.

* * * * *